US005413380A

United States Patent [19]

Fernandez

[11] Patent Number: 5,413,380

[45] Date of Patent: May 9, 1995

[54] GYROSCOPIC IN-LINE BELT ROLLER SKATE

[76] Inventor: Juan M. Fernandez, 49 North Ridge Rd., Livingston, N.J. 07039

[21] Appl. No.: 134,754

[22] Filed: Oct. 12, 1993

[51] Int. Cl.[6] ..... A63C 17/10; A63C 17/26

[52] U.S. Cl. ..... 280/844; 280/11.19; 280/11.27; 362/61

[58] Field of Search ..... 280/844, 11.19, 11.27, 280/11.28, 11.22, 11.23; 362/61

[56] References Cited

U.S. PATENT DOCUMENTS 1,583,114 5/1926 Bierly ..... 280/844
1,960,234 7/1932 Eckels ..... 280/844
2,412,290 8/1943 Rieske ..... 280/844

*Primary Examiner*—Richard M. Camby
*Attorney, Agent, or Firm*—Hugh E. Smith

[57] ABSTRACT

An in-line roller skate having at least one gyroscopic stabilizer mechanically coupled to at least one wheel of the skate for providing stabilization and improved coasting of the skate. The at least one stabilizer is positioned beneath the boot of the skate proximate the user's longitudinal center of gravity and is coupled to one or more of the wheels by a drive belt. An alternate embodiment of the present invention includes a generator driven by one or more of the skate wheels for supplying electrical power to a plurality of lights on the skate.

2 Claims, 4 Drawing Sheets

GYROSCOPIC IN-LINE BELT ROLLER SKATE

BACKGROUND OF THE INVENTION

1. Field of the Invention

The present invention relates to skates and more particularly pertains to gyroscopic in-line belt roller skates which have at least one gyroscopic stabilizer located thereon for providing stabilization and improved coasting of the skate.

2. Description of the Prior Art

The use of skates is known in the prior art. More specifically, skates heretofore devised and utilized for the purpose of providing an apparatus upon which a person may skate are known to consist basically of familiar, expected and obvious structural configurations, notwithstanding the myriad of designs encompassed by the crowded prior art which have been developed for the fulfillment of countless objectives and requirements.

For example, an in-line roller skate with axle aperture plugs for simplified wheel installation is illustrated in U.S. Pat. No. 5,048,848 which utilizes dual position, eccentric axle aperture plugs that are received in the axle apertures of the skate frame to allow mounting of the wheels in either of two distinct orientations.

A wheeled ski skate is disclosed in U.S. Pat. No. 3,891,225 which is adapted to simulate the sport of skiing. Each skate comprises an elongated first platform adapted to be secured to the skier's foot, a second platform, roller means supporting the platforms, an axial hinge interconnecting the platforms and permitting relative rotation of the platforms about a longitudinal axis of the ski skate, and spring means interposed between the platforms for biasing the platforms to a generally horizontal neutral position.

Another patent of interest is U.S. Pat. No. 4,909,523 which describes an in-line roller skate including a new light weight frame and brake of synthetic material which embodies structurally interacting components that cooperate to counter and absorb the strain and shock of road bumps and vibrations encountered at high speeds by heavy riders which have, in the past, required heavy, metal frames.

Other relevant patents include U.S. Pat. Nos. 4,132,425, and 4,886,298.

While these devices fulfill their respective, particular objectives and requirements, the aforementioned patents do not describe an in-line roller skate having at least one gyroscopic stabilizer mechanically coupled to at least one wheel of the skate for providing stabilization and improved coasting of the skate.

Furthermore, none of the known prior art skates teach or suggest a skate having a plurality of wheels over which a impact-absorbing belt traverses for providing improved ground contact between the skate and a ground surface.

In these respects, the gyroscopic in-line roller skate according to the present invention substantially departs from the conventional concepts and designs of the prior art, and in so doing provides an apparatus primarily developed for the purpose of providing stabilization, improved coasting of a skate, and improved ground contact between the skate and a ground surface.

SUMMARY OF THE INVENTION

In view of the foregoing disadvantages inherent in the known types of skates now present in the prior art, the present invention provides a new gyroscopic in-line roller skate construction having at least one gyroscopic stabilizer coupled thereto for providing stabilization and improved coasting of the skate. As such, the general purpose of the present invention, which will be described subsequently in greater detail, is to provide a new gyroscopic in-line roller skate apparatus which has many of the advantages of the skates mentioned heretofore and many novel features that result in a gyroscopic in-line roller skate which is not anticipated, rendered obvious, suggested, or even implied by any of the prior art skates, either alone or in any combination thereof.

To attain this, the present invention essentially comprises an in-line roller skate having at least one gyroscopic stabilizer mechanically coupled to at least one wheel of the skate for providing stabilization and improved coasting of the skate. The at least one stabilizer is positioned beneath the boot of the skate proximate the user's longitudinal center of gravity and is coupled to one or more of the wheels by a drive belt. An alternate embodiment of the present invention includes a generator driven by one or more of the skate wheels for supplying electrical power to a plurality of lights on the skate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gyroscopic in-line roller skate apparatus which has many of the advantages of the skates mentioned heretofore and many novel features that result in a gyroscopic in-line roller skate which is not anticipated, rendered obvious, suggested, or even implied by any of the prior art skates, either alone or in any combination thereof.

It is another object of the present invention to provide a new gyroscopic in-line roller skate which may be easily and efficiently manufactured and marketed.

It is a further object of the present invention to provide a new gyroscopic in-line roller skate which is of a durable and reliable construction.

An even further object of the present invention is to provide a new gyroscopic in-line roller skate which is susceptible of a low cost of manufacture with regard to both materials and labor, and which accordingly is then susceptible of low prices of sale to the consuming public, thereby making such gyroscopic in-line roller skates economically available to the buying public.

Still yet another object of the present invention is to provide a new gyroscopic in-line roller skate which provides in the apparatuses and methods of the prior art some of the advantages thereof, while simultaneously overcoming some of the disadvantages normally associated therewith.

Still another object of the present invention is to provide a new gyroscopic in-line roller skate having a pair of gyroscopic stabilizers mechanically coupled to one wheel of the skate for providing stabilization and improved coasting thereof.

Yet another object of the present invention is to provide a new gyroscopic in-line roller skate which includes a generator driven by a rear wheel of the skate for supplying electrical power to a plurality of lights on the skate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
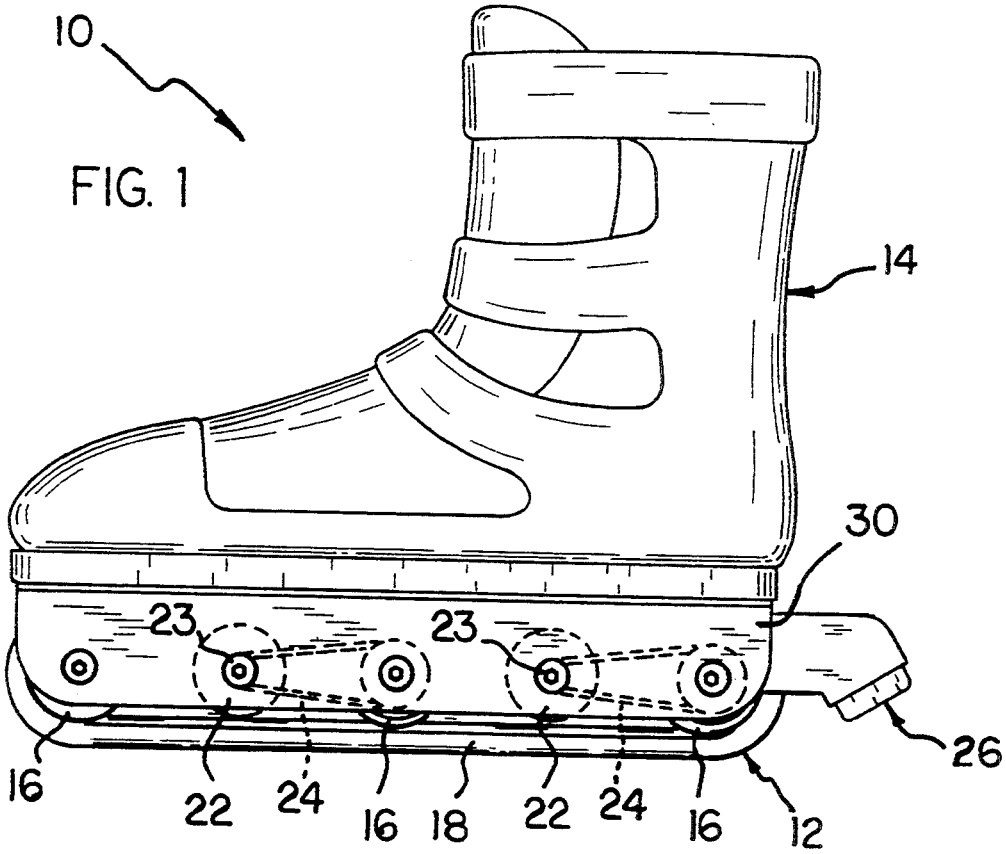
FIG. 1 is a side elevation view of first embodiment of a gyroscopic in-line roller skate comprising the present invention.

With reference now to the drawings, and in particular to FIGS. 1–6 thereof, a new gyroscopic in-line roller skate embodying the principles and concepts of the present invention and generally designated by the reference numeral 10 will be described.

Figure 2:
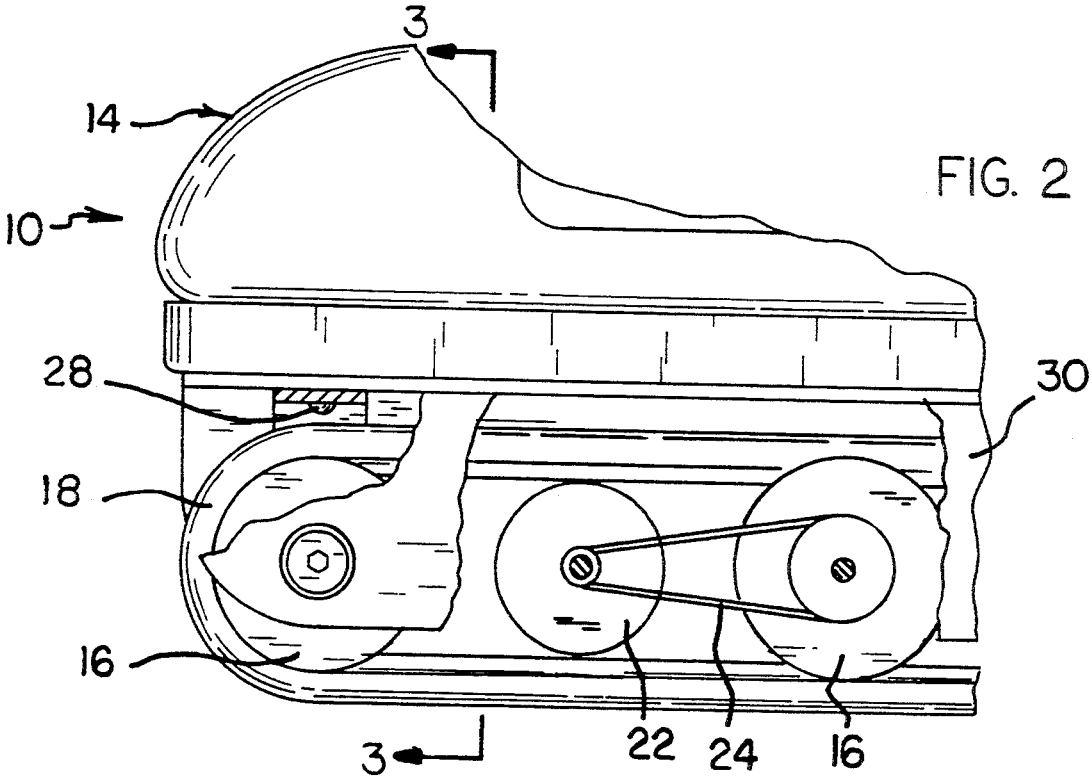
FIG. 2 is an enlarged side view of a portion of the present invention.

The gyroscopic in-line belt roller skate 10 comprises an in-line roller assembly 12 which is connected to a boot 14 into which a user may place a foot. The in-line roller assembly 12 is secured to a bottom of the boot 14 and has a plurality of wheels 16 arranged and rotatably coupled thereto in an aligned manner which operate to support and facilitate a translation of a belt 18 positioned thereover. The belt 18 is an endless loop formed of an elastomeric material or the like and it engages the ground to allow the in-line roller assembly 12 and the associated boot 14 to travel thereover. A pair of gyroscopic stabilizers 22 are rotatably mounted beneath the boot 14 within the roller assembly 12. The gyroscopic stabilizers 22 are each mechanically coupled by drive belts 24, as best illustrated in FIGS. 1 and 2, to one of the plurality of wheels 16 so as to rotate proportionally relative thereto. A brake assembly 26 is also secured to a rear area of the in-line roller assembly 12 and will facilitate a braking of the roller skate 10 upon contacting a ground surface.

The gyroscopic stabilizers 22 are each mechanically coupled by one of the drive belts 24 to one of the plurality of wheels 16 and may be accelerated by a forward motion of the skate provided by a user in a conventional skating manner. In the preferred embodiment the gyroscopic stabilizers 22 rotate at approximately five times the speed of one of the plurality of wheels 16. The stabilizers 22 are operable to maintain a vertical position of the skate and to provide improved coasting of the skate.

Figure 3:
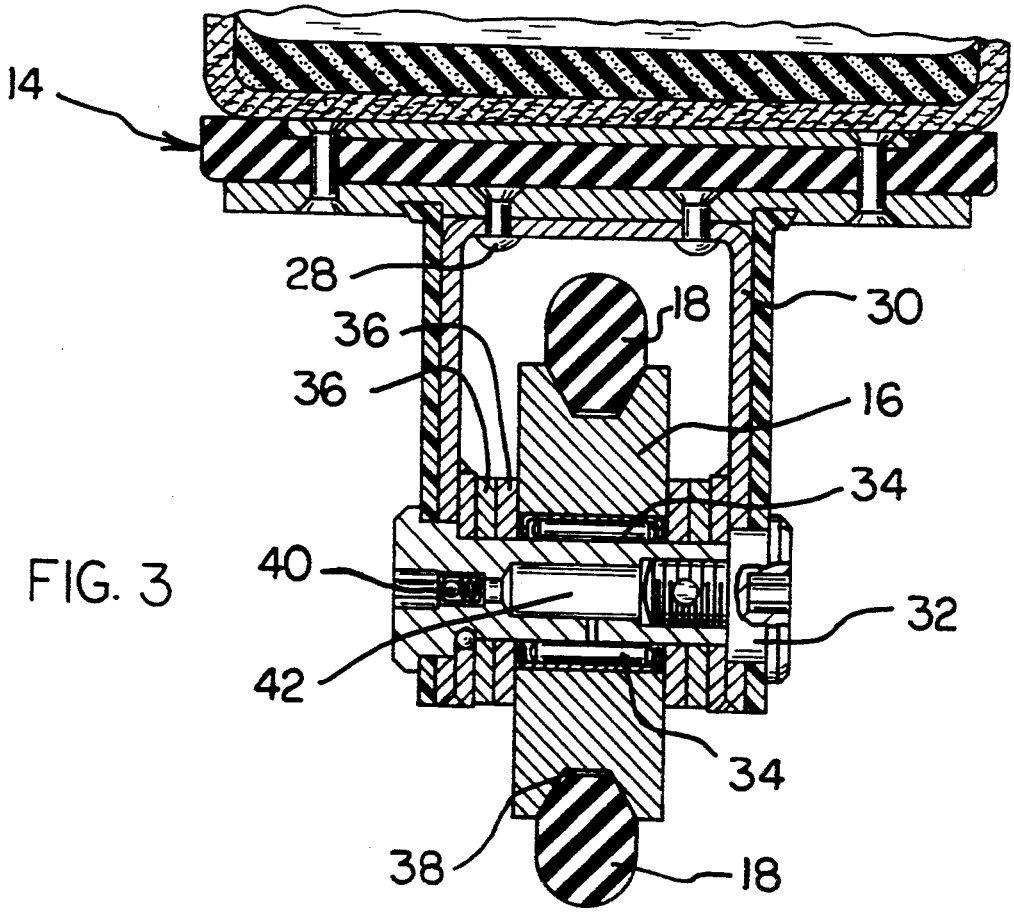
FIG. 3 is a cross sectional view taken along line 3–3 of FIG. 2.

More specifically, it will be noted that the gyroscopic in-line roller skate 10 comprises an in-line roller assembly 12 which is fixedly secured to a boot 14 by a plurality of rivets 28, as best illustrated in FIG. 3. The boot 14 is of a conventional design and is operable to receive and support a user's foot therein. A pair of gyroscopic stabilizers 22 are rotatably mounted beneath the boot 14 within the roller assembly 12 upon a pair of gyroscopic axles 23 . The gyroscopic stabilizers 22 are each mechanically coupled by drive belts 24 to one of the plurality of wheels 16 so as to rotate proportionally therewith, as best illustrated in FIGS. 1 and 2. The gyroscopic stabilizers 22 are preferably constructed in a manner which provides each stabilizer with a relatively high moment of inertia. A brake assembly 26 is also secured to a rear area of the in-line roller assembly 12 and serves to slow the skate 10 upon a contact with a ground surface.

The in-line roller assembly 12 is comprised of a substantially U-shaped channel wheel support 30 having a plurality of unlabelled apertures which allow a plurality of wheel axles 32 to pass therethrough, as illustrated in FIG. 3. The wheel axles 32 each support one of the plurality of wheels 16 upon a plurality of roller bearings 34. A plurality of bushings 36 are present between each of the plurality of wheels 16 and the U-shaped channel wheel support 30 to allow each of the wheels 16 to freely rotate relative thereto. The belt 18 resides in a groove 38 which is integrally or otherwise formed around a circumferential periphery of each of the wheels 16. The belt 18 is an endless loop formed of an elastomeric material or the like and it engages the ground to allow the in-line roller assembly 12 and the associated boot 14 to travel thereover while improving ground contact between the skate and the associated ground surface. Each of the axles 32 is equipped with a ball valve 40 which allows oil to be injected through oil passageways 42 onto the roller bearings 34 in a conventional manner.

Figure 5:
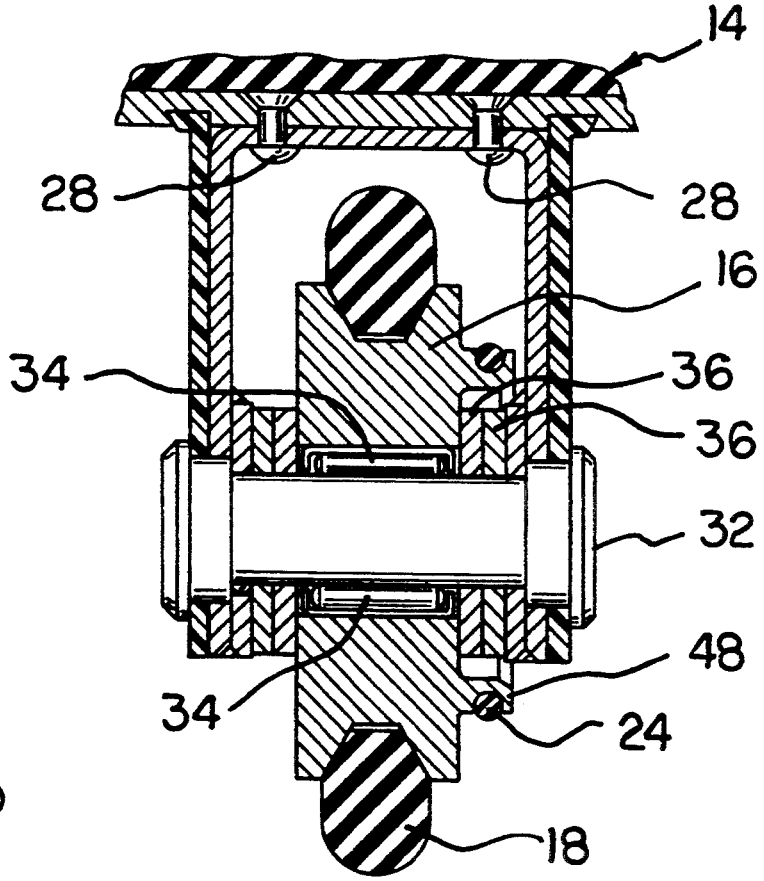
FIG. 5 is a cross sectional view taken along line 5—5 of FIG. 4.
Figure 6:
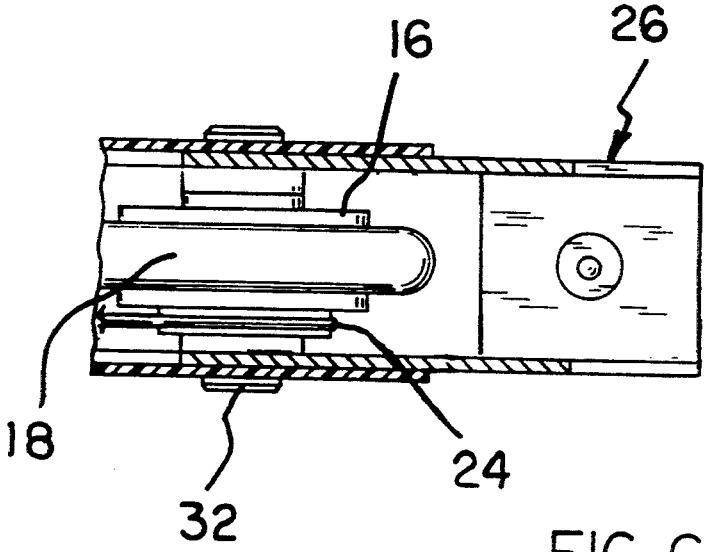
FIG. 6 is a cross sectional view taken along line 6—6 of FIG. 4.

FIGS. 5 and 6 detail the mechanical coupling between one of the drive belts 24 and one of the plurality of wheels 16. A pulley 48 is integrally or otherwise connected to one of the plurality of wheels 16, as best shown in FIG. 5. The pulley 48 includes an unlabelled groove integrally present therein which receives and frictionally engages the drive belt 24. The drive belt 24 then proceeds towards and engages an unlabeled pulley portion of the associated gyroscopic stabilizer 22 in a similar manner to cause a rotation of the stabilizer which is proportional to that of the associated wheel 16. In the preferred embodiment, the gyroscopic stabilizers 22 each rotate at approximately five times the speed of the wheels 16.

Figure 4:
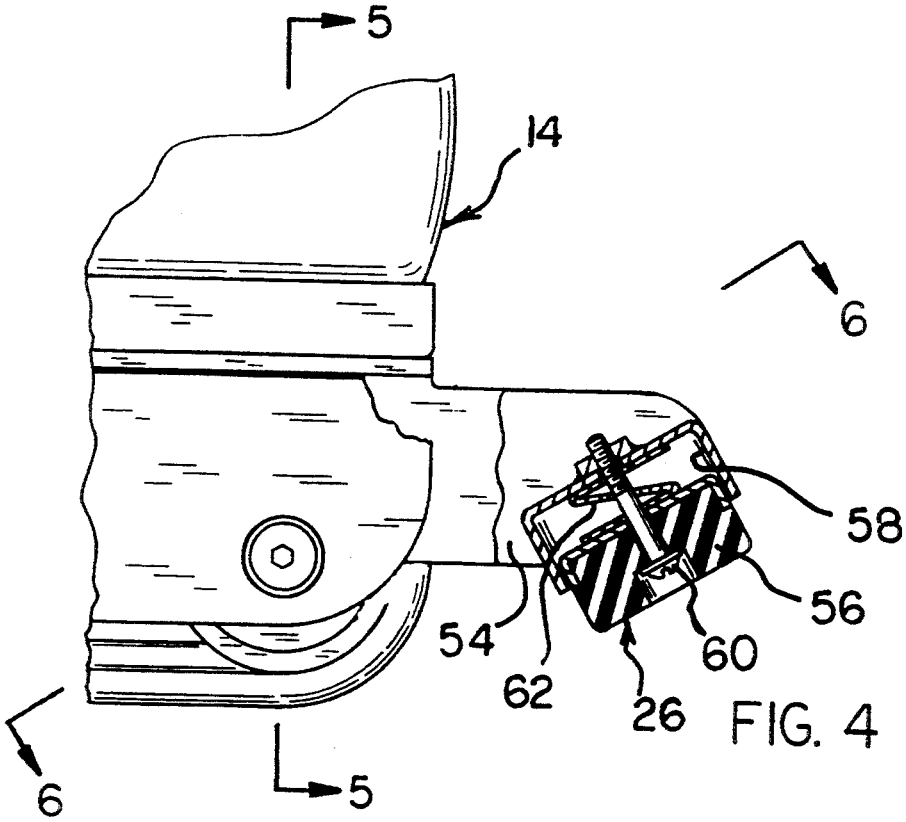
FIG. 4 is an enlarged view, partially in cross section, of a portion of the present invention.

Secured to a rear area of the in-line roller assembly 12, as best illustrated in FIG. 4, is the brake assembly 26 which comprises a brake support 54 that supports a brake pad 56 in a cavity 58 which is integrally present therein. A threaded fastener 60 projects through an unlabelled aperture in a center of the brake pad 56 and movably secures the brake pad upon a spring 62 within the cavity 58. The brake assembly 26 is operable to slow and stop the in-line roller skate 10 whenever the brake pad 56 is engaged to a ground surface by a pivoting of the skate which will provide such contact.

Figure 7:
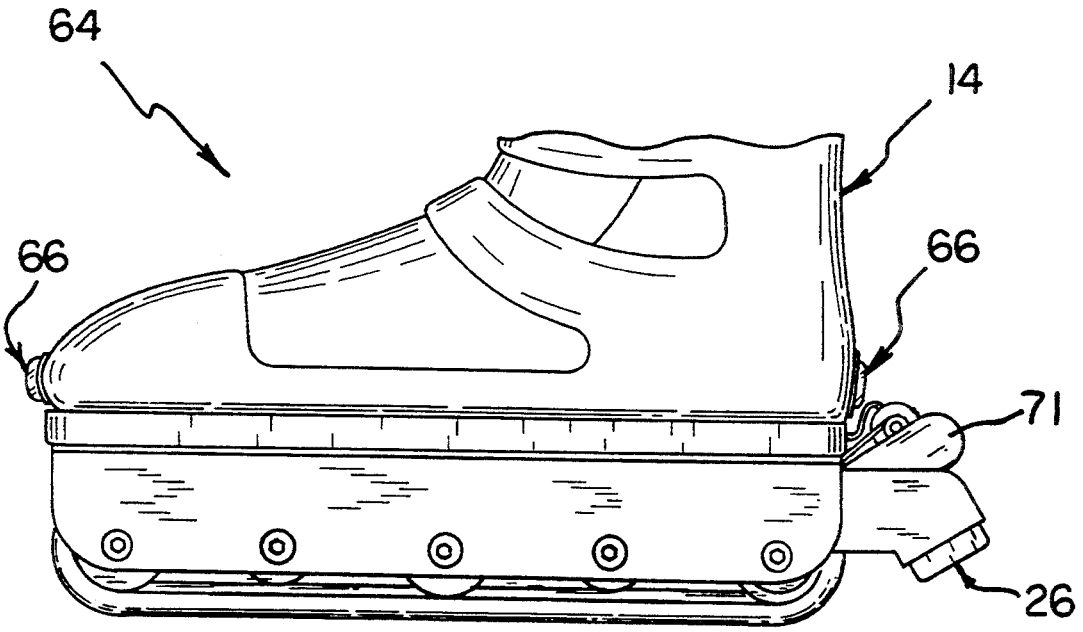
FIG. 7 is a side elevation view of a portion of a second embodiment of the present invention.
Figure 8:
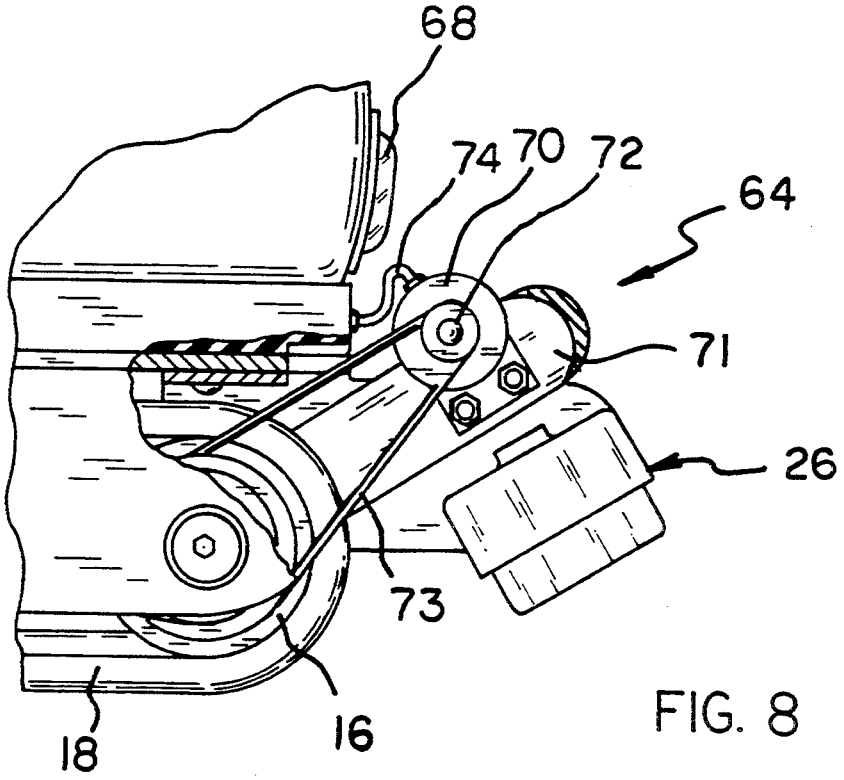
FIG. 8 is an enlarged side view, partially in cross section, detailing a portion of the second embodiment.

A second embodiment of the present invention as generally designated by the reference numeral 64 which comprises substantially all of the features of the foregoing embodiment 10 and which further comprises a pair of light assemblies 66 will now be described. As best shown in FIGS. 7–8 it can be shown that the light assemblies 66 are located in both a front and a rear area of the boot 14 and are comprised of an unillustrated light bulb contained within a transparent cover 68. A generator 70 is fixedly secured to a generator support 71 and includes a pulley 72 which engages a generator belt 73 passing over a portion of the rear-most wheel 16. The pulley 72 rotates as a result of its engagement with the generator belt 73 and is operable to turn an internal portion of the generator 70, thereby generating electrical power in a conventional manner which may be communicated to the light assemblies 66 through wires 74, as best shown in FIG. 8. The light assemblies 66 are energized whenever electrical power is produced by the generator 70 as a result of a forward movement of the roller skate 64. In the preferred embodiment the light assemblies include unlabeled colored lenses which provide a substantially white light at a front end of the boot 14 and a substantially red light at a rear end of the boot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gyroscopic in-line roller skate comprising:

a boot having a sole;

a wheel support secured to said sole;

a plurality of wheels rotatably secured to said wheel support, said plurality of wheels being centered in a common plane;

a gyroscopic stabilizer means in mechanical communication with at least one of said plurality of wheels for imparting a gyroscopic resistance to rotational movement of said boot in a predetermined direction, said gyroscopic stabilizer means comprising a gyroscopic stabilizer rotatably coupled to said wheel support, and a pulley belt frictionally engaged to both said gyroscopic stabilizer and one of said plurality of wheels, whereby said at least one gyroscopic stabilizer rotates proportionally with said wheel;

a belt frictionally engaged with at least two of said plurality of wheels for engaging a ground surface;

at least one light assembly mounted to said boot; and, a generator in mechanical communication with at least one of said plurality of wheels, said generator being electrically connected to said at least one light assembly for providing electrical power thereto.

2. The gyroscopic in-line roller skate of claim 1, and further comprising a brake assembly means secured to said wheel support for selectively decelerating said skate, said brake assembly comprising a brake pad mounted to said wheel support and selectively engagable to said ground surface.

* * * * *